US009329512B1

(12) United States Patent
Sambhy et al.

(10) Patent No.: US 9,329,512 B1
(45) Date of Patent: May 3, 2016

(54) BIO-BASED TONER COMPOSITIONS

(71) Applicant: XEROX CORPORATION, Norwalk, CT (US)

(72) Inventors: Varun Sambhy, Pittsford, NY (US); Juan A. Morales-Tirado, Henrietta, NY (US); Santokh S. Badesha, Pittsford, NY (US); Susan J. LaFica, Fairport, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/564,710

(22) Filed: Dec. 9, 2014

(51) Int. Cl.
*G03G 9/08* (2006.01)
*G03G 9/087* (2006.01)
*G03G 9/097* (2006.01)

(52) U.S. Cl.
CPC ..... *G03G 9/08784* (2013.01); *G03G 9/08* (2013.01); *G03G 9/0802* (2013.01); *G03G 9/0819* (2013.01); *G03G 9/08775* (2013.01); *G03G 9/097* (2013.01); *G03G 9/09766* (2013.01); *G03G 9/09775* (2013.01)

(58) Field of Classification Search
CPC ..... G03G 9/097; G03G 9/09766; G03G 9/09775; G03G 9/08775
USPC ..... 430/108.1, 108.15
See application file for complete search history.

(56) References Cited

U.S. PATENT DOCUMENTS 5,556,727 A 9/1996 Ciccarelli et al.
7,887,982 B2 2/2011 Vijayendran et al.

*Primary Examiner* — Mark A Chapman
(74) *Attorney, Agent, or Firm* — Pillsbury Winthrop Shaw Pittman LLP

(57) ABSTRACT

Bio-based toner compositions that exhibit excellent performance and provide high print quality. More specifically, the present bio-based toner compositions comprise greater than 20% bio-resins but avoid the moisture sensitivity issues that bio-resins are prone to by also including one or more oil additives.

20 Claims, 13 Drawing Sheets

BIO-BASED TONER COMPOSITIONS

TECHNICAL FIELD

The presently disclosed embodiments are generally directed to bio-based toner compositions that exhibit excellent performance and provide high print quality. More specifically, the presently disclosed embodiments are directed to toner compositions that include bio-derived resins and oil additives that prevent the moisture sensitivity that commonly impacts such resins.

BACKGROUND

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

There is a constant desire to improve the characteristics and performance of toner compositions. One area of possible improvement focuses on the resins used in making the toner compositions, as the resin comprises a substantial portion of the toner composition. In particular, one characteristic that has gained interest in recent years is the sustainability of the resin. As environmental concerns have grown, it has become important for manufacturers to reduce their carbon footprint and dependency on fossil fuels. One way to achieve this goal in connection with toner production is to use bio-based raw material feedstock to make the toners. However, such bio-based materials sometimes do not perform as well as their conventional counterparts. Thus, there remains a need to produce a bio-based toner composition that can perform on par with the conventional toner compositions. In the presently disclosed embodiments the term "conventional toner compositions" is used to describe toner compositions made from resins derived from fossil fuels.

BRIEF SUMMARY

According to embodiments illustrated herein, there is provided a bio-derived toner composition comprising a bio-based resin and oil additives that addresses the shortcomings discussed above. In particular, the embodiments provide bio-based toner compositions that exhibit excellent performance and provide high print quality. More specifically, the present bio-based toner compositions comprise greater than 20% bio-resins but avoid the moisture sensitivity issues that bio-resins are prone to by also including one or more oil additives.

An embodiment may include a toner comprising: a bio-based toner comprising: a resin blend comprising a petroleum based resin and a bio-based resin one or more hydrophobic oil additives; a colorant; and one or more additives, wherein the toner has bio-content of greater than 25% by weight and does not exhibit moisture sensitivity.

In another embodiment, there is provided a toner comprising: a developer comprising: a bio-based toner; and toner carrier, the bio-based toner comprising a resin blend comprising a petroleum based resin and a bio-based resin one or more hydrophobic oil additives; a colorant; and one or more additives, wherein the toner has bio-content of greater than 25% by weight and does not exhibit moisture sensitivity.

In another embodiment, there is provided a method of making a toner comprising a method of making a toner comprising mixing a bio-resin with a colorant to form a toner mixture; grinding the toner mixture; classifying the ground toner mixture to form toner particles; and mixing the toner particles with one or more hydrophobic oil additives to form coated toner particles.

DETAILED DESCRIPTION

Figure 1:
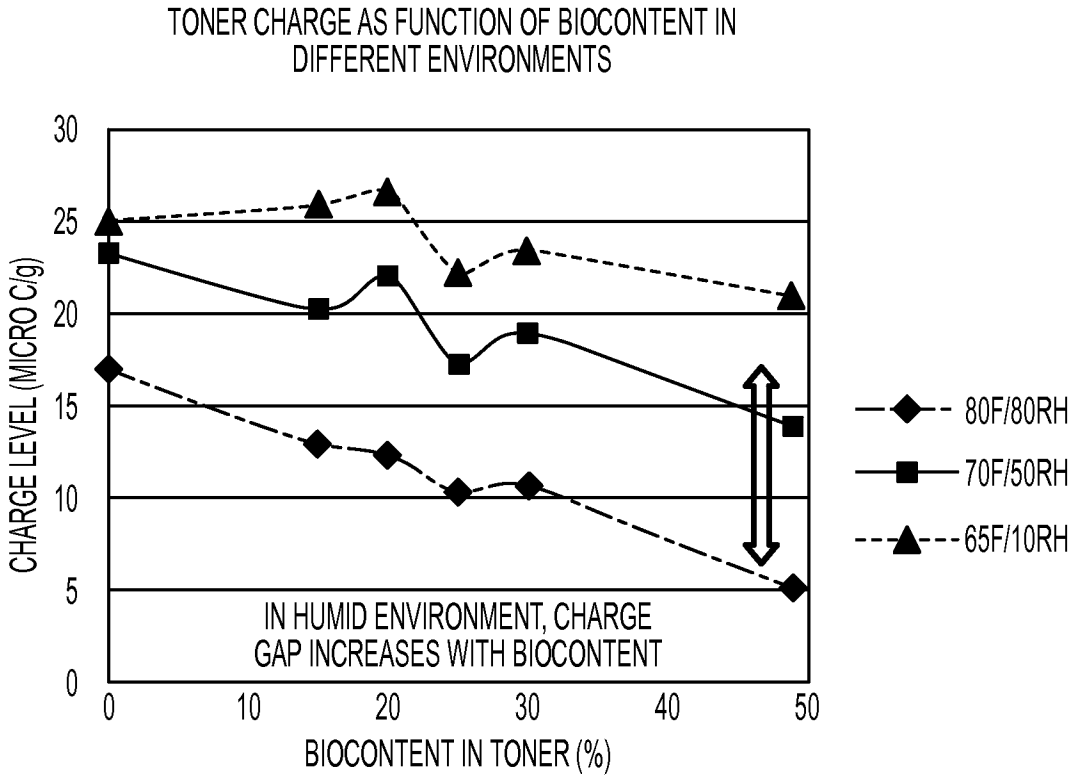
FIG. 1 is a graph illustrating A zone charge as a function of bio-resin content in various bio-based toner compositions.

In the following description, it is understood that other embodiments may be used and structural and operational changes may be made without departing from the scope of the present disclosure.

Energy and environmental policies, increasing and volatile oil prices, and public/political awareness of the rapid depletion of global fossil reserves have created a need to find sustainable monomers derived from biomaterials. The present embodiments disclose bio-derived resins and the use of those resins for "green" toner compositions. Pending USDA guidelines say a bio-based toner must have greater than 20% bio content to be marketed as "green." By "bio-derived" or "bio-based" is used to mean a material comprised of one or more monomers that are derived from plant material. By using bio-derived feedstock, which are renewable, manufacturers may reduce their carbon footprint and move to a zero-carbon or even a carbon-neutral footprint. Bio-based polymers or bio-resins are also very attractive in terms of specific energy and emission savings. Utilizing bio-based feedstock can help provide new sources of income for domestic agriculture, and reduce the economic risks and uncertainty associated with reliance on petroleum imported from unstable regions.

A viable bio-based toner product should have cost structure and functional performance equivalence with current non-bio based toners. One of the known performance shortfalls in current bio-based toners is moisture sensitivity of the resin. The bio-resins have polar groups in the polymer chains that attract water molecules. Thus, toners made with bio-resin absorb water in A zone conditions (80° F./80% relative humidity) and lead to low charge which is out of the machine latitude window. Moreover, the moisture absorption makes the resin plastic and consequently difficult to grind (low throughput), which leads to increasing processing costs. Hence, the present embodiments provide methods and additives to reduce moisture sensitivity of bio-resin based toners and increase A zone charge, which is highly desirable.

Bio-Resin

The present embodiments provide a "green" toner composition that comprises at least 25% of a bio-resin or a resin that is derived from bio-based raw material feedstock, such as plant materials. The bio-resin has about 50% bio-content so it takes about 50% of the toner formulation to achieve 25% bio-content. In further embodiments, the bio-based toner composition comprises from about 25% to about 95% or from about 25% to about 75% from about 50% to about 75% by weight of the bio-resin. Disclosed herein are amorphous polyester resins for use in toner fabrication that contain up to 25% by weight of bio-derived content, or from about 15 to about 25% by weight of bio-derived content, or from about 20 to about 25% by weight of bio-derived content, as based on the total weight of the resin. In embodiments, the bio-derived content comprises one or more monomers that are derived from a plant material, such as for example, soy or cottonseed. In embodiments, the polyester resin with partial bio-content is a melt-mixed blend of bio-derived resin and petroleum derived resin. The resins are described below.

The partial bio-content resins are made by dry blending resin with bio-content with a non-bio petroleum resin. This mixture of resins is added with other ingredients such as colorant, charge control agents, and wax to make the toner. Melt extrusion of a highly bio-derived amorphous polyester resin having low Tg range and a bio-derived content of about 50% or more, with a petroleum-derived amorphous polyester resin having a high Tg range in an extruder to produce a bio-based toner. The formulation of the highly bio-derived amorphous polyester is described in U.S. Pat. No. 7,887,982, Table 2B, Example 3, which is hereby incorporated by reference. Up to 10% crosslinking agents, such as trimethylpropane, may be added to adjust the rheology as needed. Any suitable dimer acid may be used. For example, the dimer acid may be obtained from cotton seeds. The petroleum based resin is a polyester produced from about a 50:50 mixture of polyalcohol and polyacid. On a molar basis the polyalcohol is about 75% propoxylated bisphenol-A and 25% ethoxylated bisphenol-A. On a molar basis the polyacid is about 80% terephthalic acid, 10% dodecylsuccinic acid, and 10% trimellitic acid. FIG. 1 shows a DSC trace of the highly bio-derived amorphous polyester resin as compared to that of the petroleum-derived amorphous polyester resin. The DSC Method used was as follows—approximately 10 mg of sample was weighed into a standard aluminum pan and analyzed using a TA Instruments Q100 by the following temperature program: 0-140° C. @ 10° C./min, 140-0° C. @ 10° C./min, Isothermal 3 min., 0-140° C. @ 10° C./min.

In embodiments, the weight ratio of the highly bio-derived amorphous polyester resin to the petroleum-derived amorphous polyester resin is from about 1:2.5 to about 1:0.9, or from about 1:2.3 to about 1:0.98 in the resin blend. These ratios are for a bioresin containing about 50% biocontent. The specific lot of bioresin used in the examples measured 54% biocontent via ASTM D-6866. In further embodiments, the highly bio-derived resin has a low onset Tg of from about 30 to about 40, or from about 31 to about 38, or from about 32 to about 36 with an endset Tg value about 15° C. higher. Shimadzu $T_{1/2}$ of from about 119° C. to about 108° C., or from about 116° C. to about 110° C. In embodiments, the petroleum-derived amorphous polyester resin has a formula of about a 50:50 mixture of polyalcohol and polyacid. On a molar basis the polyalcohol is about 75% propoxylated bisphenol-A and 25% ethoxylated bisphenol-A. On a molar basis the polyacid is about 80% terephthalic acid, 10% dodecylsuccinic acid, and 10% trimellitic acid. In further embodiments, the petroleum-derived resin has a high onset Tg of from about 50 to about 66° C., or from about 55° C. to about 65° C., or from about 59° C. to about 64° C. with an endset Tg about 8° C. higher than the onset. Shimadzu T½ from about 115° C. to about 125° C., or from about 117° C. to about 122° C.

The highly bio-derived resin and the petroleum-derived resin can be melt blended or mixed in an extruder with other ingredients such as waxes, pigments/colorants and/or one or more additive such as, for example, internal charge control agents, pigment dispersants, flow additives, embrittling agents, and the like, to form a bio-based toner. The resultant product can then be micronized by known methods, such as milling or grinding, to form the desired toner particles. The bio-derived resin of the present embodiments is present in the bio-based toner in an amount of from about 20 to about 90% by weight, or from about 22 to about 60% by weight, or from about 25 to about 50% by weight of the total weight of the toner.

As described above, the toner can further comprise a wax, colorant, and/or one or more additives.

Oil Additives

As mentioned above, toners made with bio-resins tend to absorb water. This moisture sensitivity leads to problems in A zone conditions (80° F./80% relative humidity) as it causes low charge. Furthermore, the charge gap increases with increasing bio content and limits the amount of bio-resin that can be incorporated in the toner to be marketed as "green". The relationship is shown in FIG. 1.

In the present embodiments, the bio-based toner compositions comprise oil additives that help address the moisture sensitivity of the bio-resins. The oil additives are selected from the group consisting of silicone-based oils; fluorinated oils; petroleum based mineral oils like paraffinic oils based on n-alkanes or naphthenic oils, based on cycloalkanes or aromatic oils, or based on aromatic hydrocarbons; or plant or animal based fatty acids and triglycerides; and mixtures thereof. Such oils are known to be hydrophobic and water repellants. As used herein, the term "hydrophobic" means having a property of repelling water or being incapable of dissolving in water. Without being limited by any one theory, it is hypothesized that a hydrophobic layer of oil coating the toner particles will make the bio-based toner water-repellant and thereby increase A zone charge. To test the hypothesis, a representative bio-based toner particle was blended with the various oil additives to make a toner. As further discussed in the Examples below, the oil additives coated the toner particle during blending. Control toners without oil additives were made that comprised both bio-resin particles and conventional particles (without bio-resin). All the toners were evaluated for charge in A and J zone. The bio-resin based toners blended with the silicone oil or fluorinated oil had about 5 tribo units or greater charge than the no oil bio-resin toner control. In specific embodiments, the bio-resin based toners blended with the oil additives had from about 5 tribo units to about 7 tribo units or greater charge than the no oil bio-resin toner control. This translates into an increase in A zone charge of greater than 30%, or in embodiments, from about 30 to about 50% greater than, for the oil treated bio-based toners as compared to the none oil treated bio-based toners. In embodiments, the bio-based toner of the present embodiments has an A zone charge of from about 14 to about 18, or of from about 18 to about 22.

The amine functional oils may have the following formula:

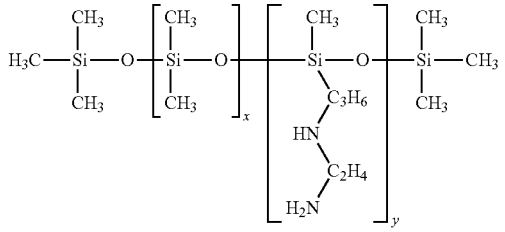

wherein x is from about 50 to about 1,000 and y is from about 1 to about 50.

The silicone-based oils may include any silicone oils such as polysiloxanes, with the chemical formula [R2SiO]n, where R is an organic group such as hydride, methyl, ethyl, or pheny land mixtures thereof. In specific examples, the silicone-based oils include AK50 (available from Wacker Gembie, GmbH (Munich, Germany)), and X82 (available from available from Wacker Gembie, GmbH (Munich, Germany)). The silicone-based oils may include those with functional groups such as amine, thiol, hydride and the like. Specific types of silicone-based oils include amine functional silicone with low amine percentage such as:

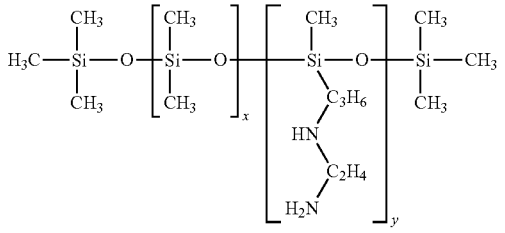

wherein y is lower than 0.1 mol, %, an amine functional silicone with high amine percentage such as:

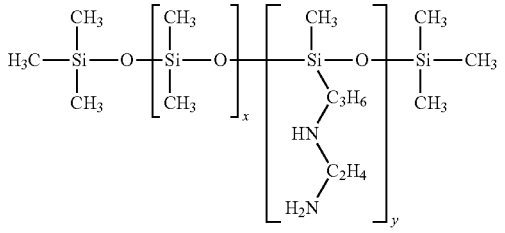

wherein y is higher than 0.1 mol %, a hydride functional silicone, a thiol-SH functional silicone and a phosphoric acid functional silicone. In particular, the amine groups can be expected to strongly interact both non-covalently and covalently with various polar and acidic groups in the bioresin of toner particle. This interaction will lead to strong binding of the oil to the toner particle. The fluorinated oils may include the following: KRYTOX grade of lubricants available from DuPont. Specific types of KRYTOX fluorinated oils include polyhexafluoropropylene oxide polymers having viscosity range of from about 10 centipoise to about 100 centipoise, or from about 100 centipoise to about 1000 centipoise. In a specific embodiment, the fluorinated oil has the following structure:

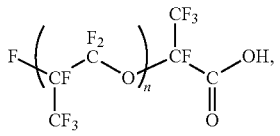

where n is from about 10 to about 1000.

In embodiments, the bio-based toner compositions comprise from about 0.1 to about 0.2% by weight of the oil additives. In further embodiments, the bio-based toner compositions comprise from about 0.15 to about 0.25% or from about 0.2 to about 0.3% by weight of the oil additives. In embodiments, the weight ratio of the oil additive to bio-resin is from about 1:8 to about 1:950, or from about 1:250 to about 1:320.

Benefits of the present embodiments include that blending the bio-based toner with oil additives increased toner A zone charging and decreased toner moisture sensitivity, which allow the toner bio mass content to be much greater than 20%. Moreover, silicone-based oils and fluorinated oils are relatively cheap materials that are non-toxic.

Waxes

Waxes with, for example, a low molecular weight $M_w$ of from about 1,000 to about 10,000, such as polyethylene, polypropylene, and paraffin waxes can be included in, or on the toner compositions as, for example, fusing release agents.

Colorants

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites M08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60% by weight, or from about 2 to about 9% by weight for color toner, and about 3 to about 60% by weight for black toner.

Other Additives

Any suitable surface additives may be selected. Examples of additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNILIN 700™ and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability.

The $SiO_2$ and $TiO_2$ should more specifically possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200% theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50% silica/50% titania to about 85% silica/15% titania (on a weight percentage basis).

Examples of suitable $SiO_2$ and $TiO_2$ are those surface treated with compounds including DTMS (decyltrimethoxysilane) or HMDS (hexamethyldisilazane). Examples of these additives are NAX50 silica, obtained from DeGussa/Nippon Aerosil Corporation, coated with HMDS; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Calcium stearate and zinc stearate can be selected as an additive for the toners of the present invention in embodiments thereof, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85% purity, for example from about 85 to about 100% pure, for the 85% (less than 12% calcium oxide and free fatty acid by weight, and less than 3% moisture content by weight)

and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95% purity (less than 0.5% calcium oxide and free fatty acid by weight, and less than 4.5% moisture content by weight), and which stearate has an average particle diameter of about 2 microns and is available from NOF Corporation (Tokyo, Japan). In embodiments, the toners contain from, for example, about 0.1 to about 5 weight % titania, about 0.1 to about 8 weight % silica, or from about 0.1 to about 4 weight % calcium or zinc stearate.

In embodiments, a charge control agent is added. In further embodiments, the charge control agent is an internal charge control agent, such as an acryl base polymeric charge control agent. In particular embodiments, the toner contains between about 0.5% and 7% by weight of the internal charge control agent.

In further embodiments, other additives such as pigment dispersants, flow additives, embrittling agents, and mixtures thereof, may be included in the toner composition.

The toner composition can be prepared by a number of known methods including melt mixing the toner resin particles, and pigment particles or colorants, followed by mechanical attrition. Other methods include those well known in the art such as melt dispersion, dispersion polymerization, suspension polymerization, extrusion, and emulsion/aggregation processes.

The resulting toner particles can then be formulated into a developer composition. The toner particles can be mixed with carrier particles to achieve a two-component developer composition.

The toner may be made by admixing resin, wax, the pigment/colorant, and the one or more additives. The admixing may be done in an extrusion device. The extrudate may then be ground, for example in a jet mill, followed by classification to provide a toner having a desired volume average particle size, for example, from about 7.5 to about 9.5 microns, or in a specific embodiment, about 8.5±0.5 microns. The classified toner is blended with external additives, which are specifically formulated in a Henschel blender and subsequently screening the toner through a screen, such as a 37 micron screen, to eliminate coarse particles or agglomerate of additives.

The following Examples are submitted to illustrate embodiments of the disclosure. The Examples are intended to be illustrative only and are not intended to limit the scope of the disclosure. Also, parts and percentages are by weight unless otherwise indicated. As used herein, "room temperature," refers to a temperature of from about 20° C. to about 30° C.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Example 1

Preparation of Control Toner (Resin has 0% Bio-Content)

The control particles were made per the formulation given in Table 1. All the ingredients were melt mixed in an extruder and the output was pulverized and classified to attain a median particle size of 7-8 microns.

TABLE 1

| Wt % | Component |
|---|---|
| 1.8% | Wax |
| 0.7% | Charge Control Agent |
| 0.9% | Wax |
| 91.2% | Resin |
| 5.4% | Colorant |

The Control particles were blended as per the following conditions in a bench top Fuji mill: Measured 37.5 g of particles into the Fuji mill cup. Then using a pipette added the oil in small drops all over the toner. The silica and titania additives were added to the particles. Another 37.5 g of particles were then placed into the Fujimill cup. The toner was blended for 150 s at 15000 rpm. The final toner formulation is given in Table 2

TABLE 2

| Wt % | Component |
|---|---|
| 99.13% | Control Particles |
| 0.71% | Silica Additive |
| 0.16% | Titania Additive |

Example 2

Preparation of Bio-Based Control Toner (about 25% Bio-Content; No Oil Additive)

Bio-based Control Toner was prepared like Example 1 except that the formulation was adjusted to contain about 25% bio-content. The bio-based particles were made per the formulation given in Table 3. All the ingredients were melt mixed in an extruder and the output was pulverized and classified to attain a median particle size of 7-8 microns.

TABLE 3

| Wt % | Component |
|---|---|
| 1.8% | Wax |
| 0.7% | Charge Control Agent |
| 0.9% | Wax |
| 40.6% | Conventional Resin |
| 42.6% | Bio-based Resin |
| 8% | Embrittling Agent |
| 5.4% | Colorant |

The bio-based particles were blended with additives like Example 1. The final toner formulation is as given in Table 4.

TABLE 4

| Wt % | Component |
|---|---|
| 99.13% | Bio-based Particles |
| 0.71% | Silica Additive |
| 0.16% | Titania Additive |

Example 3A-3D

Preparation of Bio-Based Toner with Oil (about 25% Bio-Content; Includes Oil Additives)

Particles were prepared as in Example 2 and toners were prepared as in Example 2 except that the final toner formulation was adjusted to contain 0.15% of the oil additives (either the silicone-based oil or fluorinated oil) as given in table 5A; or 0.30% of the oil additives (either the silicone-based oil or fluorinated oil) as given in table 5B. The final toner formulations are given in Table 5A and 5B.

TABLE 5A

| Wt % | Component |
|---|---|
| 98.98% | Bio-based Particles |
| 0.71% | Silica Additive |
| 0.16% | Titania Additive |
| 0.15% | Oil Additive |

TABLE 5B

| Wt % | Component |
|---|---|
| 98.83% | Bio-based Particles |
| 0.71% | Silica Additive |
| 0.16% | Titania Additive |
| 0.30% | Oil Additive |

Testing Performance: Silicone Oil

A comparison of the prepared toners is shown in Table 6. The toner formulations were as follows:

TABLE 6

| Name | Parent Particle | Particle Weight | Silica R972L | Titania SMT150 | Oil Name | Oil |
|---|---|---|---|---|---|---|
| Control (non bioresin) Toner Example 1 | Non bio-resin | 75 g | 0.585 g | 0.128 g | None | 0 mL |
| Control Bio-based Toner (no oil) Example 2 | Bio-resin | 75 g | 0.585 g | 0.128 g | None | 0 mL |
| Bio-based Toner (with AK50 oil) Example 3A | Bio-resin | 75 g | 0.585 g | 0.128 g | AK50 | 0.225 mL |
| Bio-based Toner (with X82 oil) Example 3B | Bio-resin | 75 g | 0.585 g | 0.128 g | X82 | 0.225 mL |
| Bio-based Toner (with X82 oil) Example 3C | Bio-resin | 75 g | 0.585g | 0.128 g | X82 | 0.113 mL |

Figure 2:
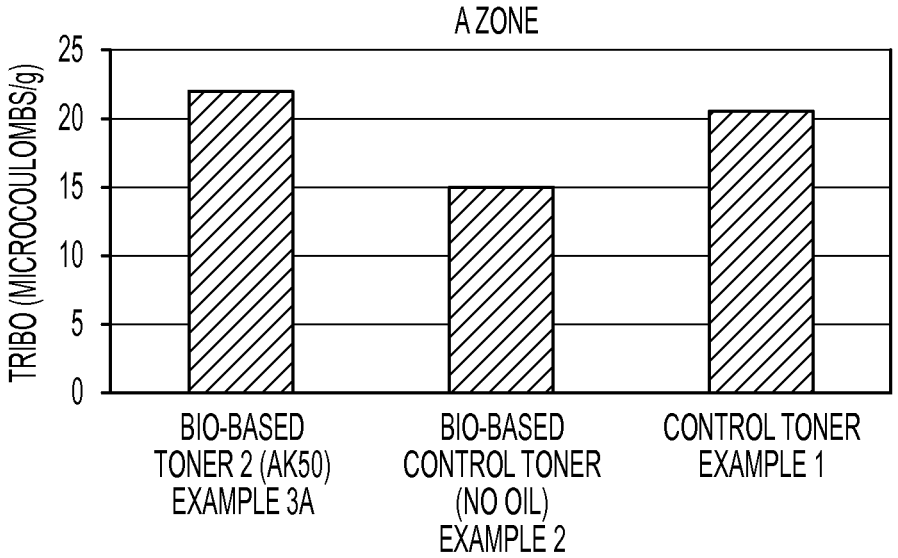
FIG. 2 is bar graph illustrating a comparison of A zone tribo of bio-resin based toner treated with silicone oil to no oil controls.
Figure 3:
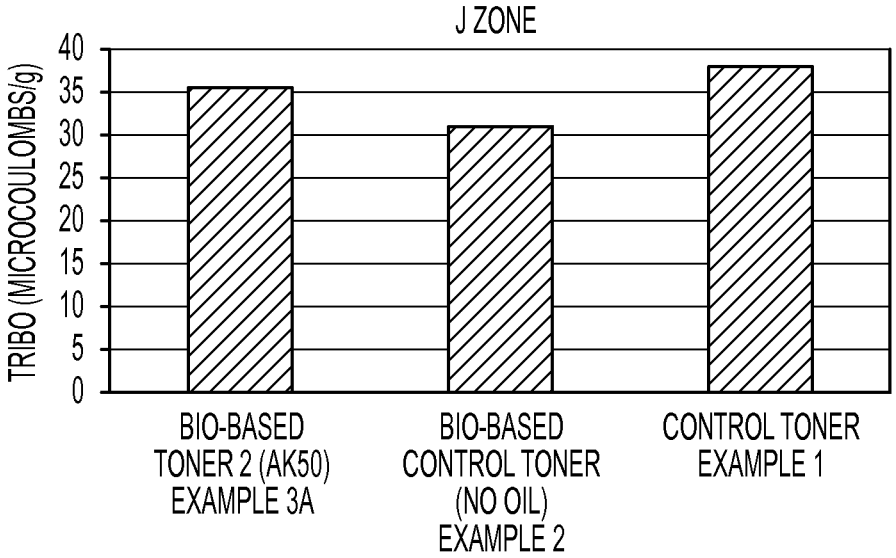
FIG. 3 is bar graph illustrating a comparison of J zone tribo of bio-resin based toner treated with silicone oil to no oil controls.

The two control toners i.e. Example 1 and Example 2 and Bio-based Toner Example 3A were evaluated for charge in A zone (80° F./80% R.H) and J zone (70° F./10% R.H). The results are shown in FIGS. 2 and 3, respectively. The bio-resin based toner was blended with AK50 oil (available from Wacker Gembie, GmbH (Munich, Germany)) had about 7 tribo units greater charge (A zone charge of 22 units; an increase in A zone charge of 45%) than the no oil bio-resin toner control. The A zone charge of oil treated bio-based toner is equivalent to that of the control (non bio-resin) toner.

Figure 4:
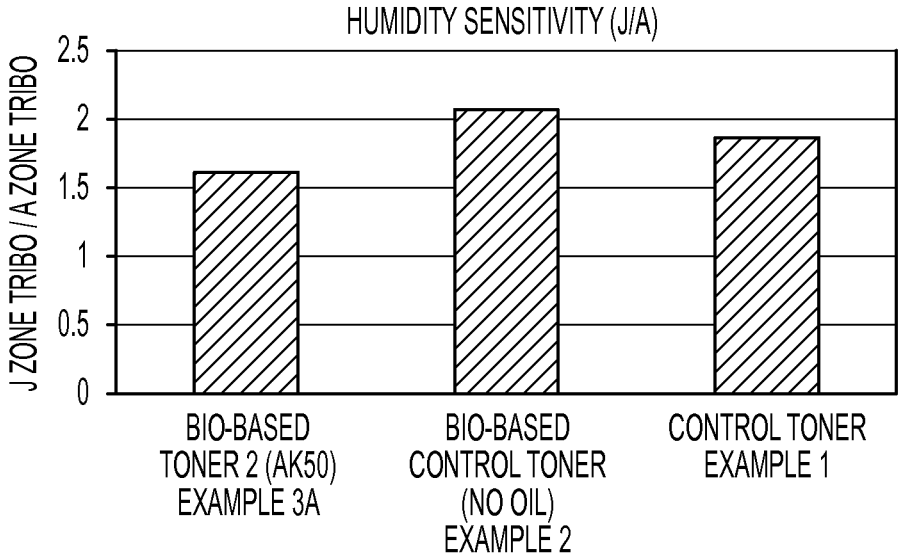
FIG. 4 is a bar graph illustrating environmental sensitivity of bio-based toners treated with silicone oil as compared to controls toners.

This is a big improvement and brings the A zone charge of the bio-based toner to within conventional (non bio-resin) toner specifications. The J zone charge of the bio-based toner was slightly increased over the no oil bio-based toner, but was still comparable to that of the conventional toner. Thus, the data demonstrates that the oil additives clearly increase the A zone charge without increasing the J zone charge to out of specification limits in this example. In addition, we can see from FIG. 4 that the environmental sensitivity of the toners (defined as J/A zone tribo) of the silicone oil treated toner is lower than both control toners.

The toner blends, including the one with silicone oil, were scaled up in a pilot plant using a 10 L Henschel blender:

1. Blend conditions:—10 L-1 Henschel blender, Standard tool, Batch size 3.6 lb, Tool speed—2752 rpm, Blend Time—8 min.
2. Screen conditions:—9 inch screener, 106 micron screen size A bio-resin based toner that was blended with a hydride functional silicone such as X82 (available from available from Wacker Gembie, GmbH (Munich, Germany) was also evaluated at two amounts. The results are shown in Table 7 below. As expected, blending the bio-based toner with oil increased A zone Tribo by about 6.5 (38%) tribo units over the no oil bio-based control.

TABLE 7

| Toner | Parent Particle | Oil Name | Oil (%) | Oil Amount | Tribo A Zone | Tribo J Zone | Tribo B Zone | Humidity Sensitivity (J/A ratio) |
|---|---|---|---|---|---|---|---|---|
| Control (non bioresin) Toner Example 1 | Non bio-resin | N/A | 0% | 0 mL | 19.74 | 37.65 | 30.2 | 1.9 |
| Control Bio- | Bio-resin | N/A | 0% | 0 mL | 17 | 30.35 | 24.39 | 1.8 |

TABLE 7-continued

| Toner | Parent Particle | Oil Name | Oil (%) | Oil Amount | Tribo A Zone | Tribo J Zone | Tribo B Zone | Humidity Sensitivity (J/A ratio) |
|---|---|---|---|---|---|---|---|---|
| based Toner (no oil) Example 2 | | | | | | | | |
| Bio-based Toner (with AK50 oil) Example 3A | Bio-resin | AK50 | 0.30% | 4.9 mL | 23.49 | 32.95 | 28.79 | 1.4 |
| Bio-based Toner (with X82 oil) Example 3B | Bio-resin | X82 | 0.30% | 4.9 mL | 23.64 | 32.15 | 29.1 | 1.4 |
| Bio-based Toner (with X82 oil) Example 3C | Bio-resin | X82 | 0.15% | 2.5 mL | 23.28 | 31.98 | 28.95 | 1.4 |

Figure 5:
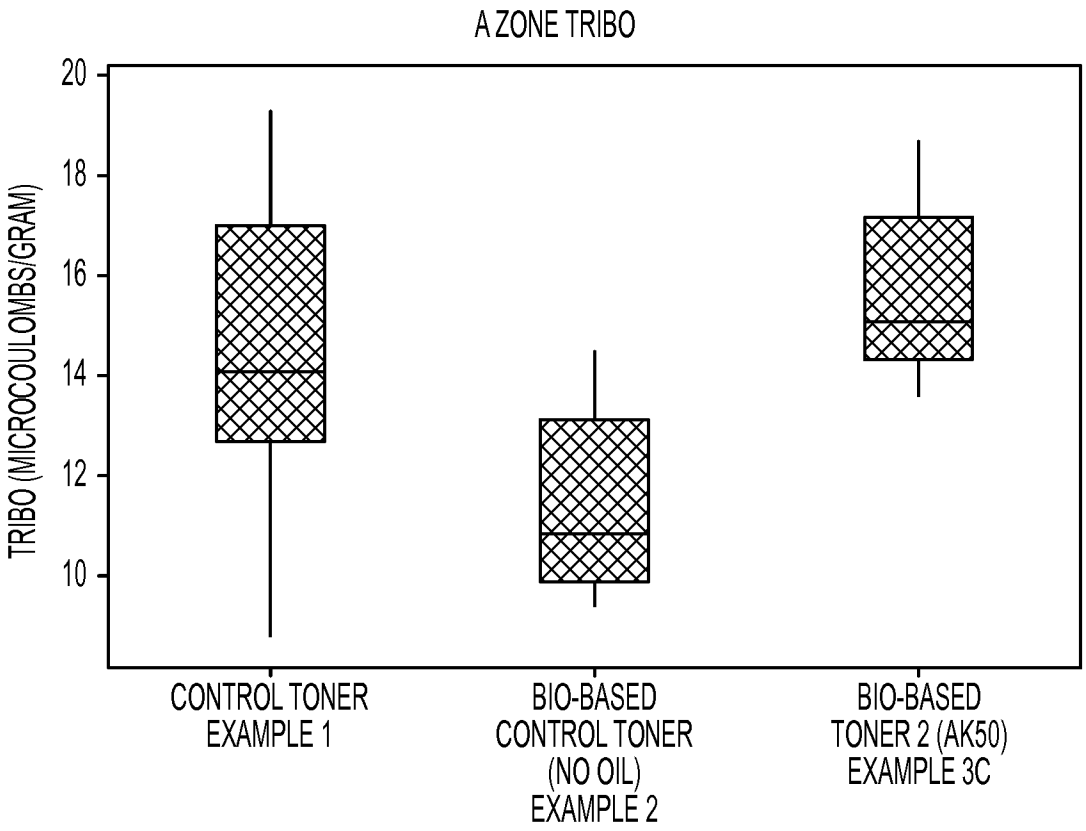
FIG. 5 is a graph illustrating charge in A zone for a bio-resin based toner as compared to a bio-based control toner without oil and a conventional control toner without oil.
Figure 6:
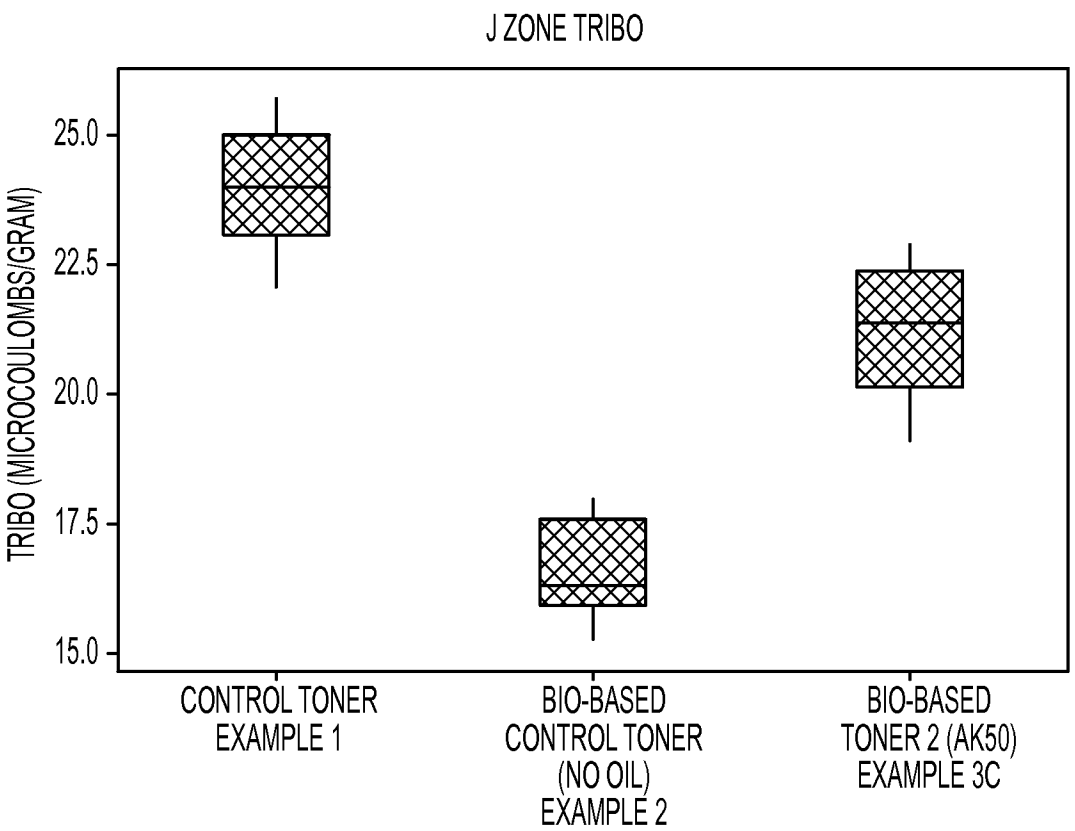
FIG. 6 is a graph illustrating charge in J zone for a bio-resin based toner as compared to a bio-based control toner without oil and a conventional control toner without oil.
Figure 7:
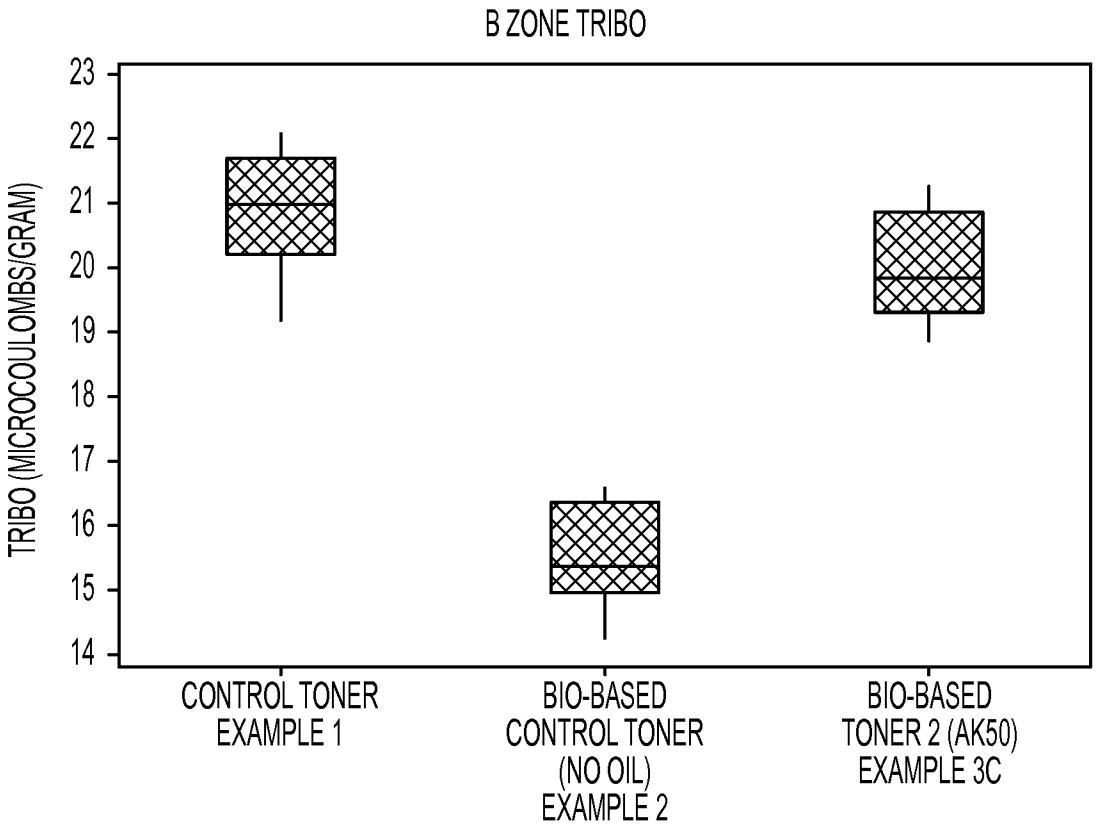
FIG. 7 is a graph illustrating charge in B zone for a bio-resin based toner as compared to a bio-based control toner without oil and a conventional control toner without oil.
Figure 8:
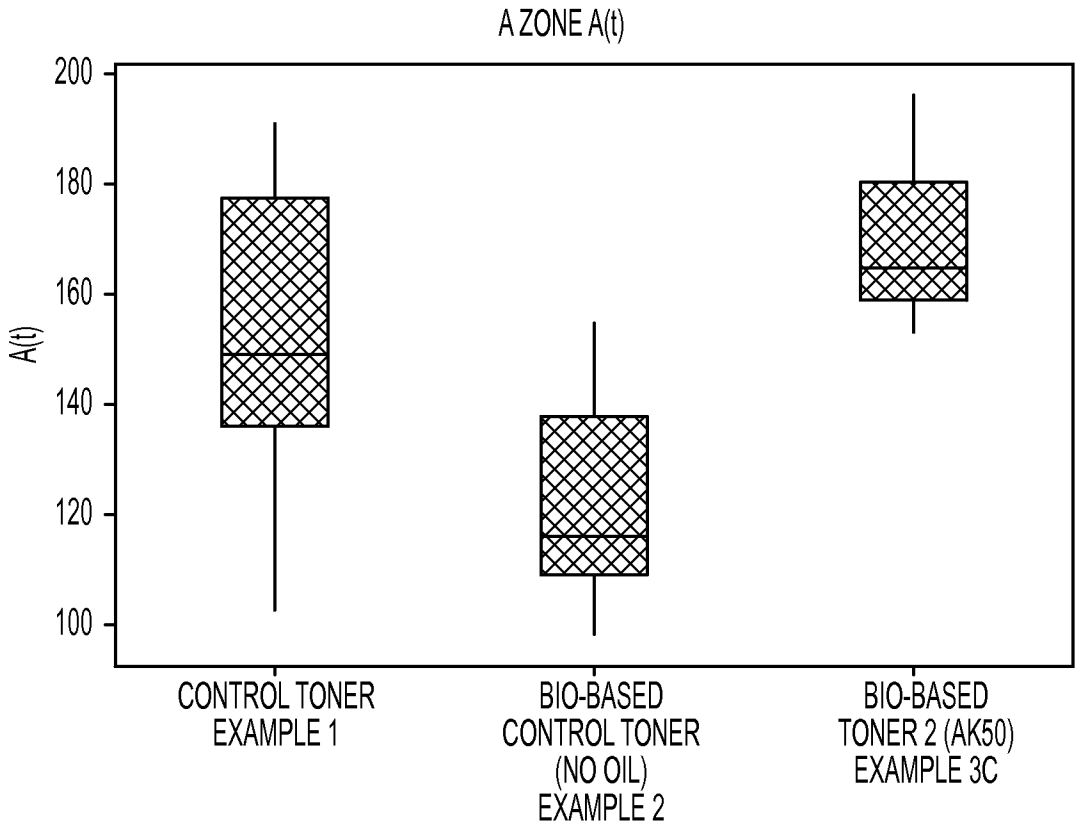
FIG. 8 is a graph illustrating the range in the intrinsic charge parameter A(t) in A zone for a bio-resin based toner as compared to a bio-based control toner without oil and a conventional control toner without oil.
Figure 9:
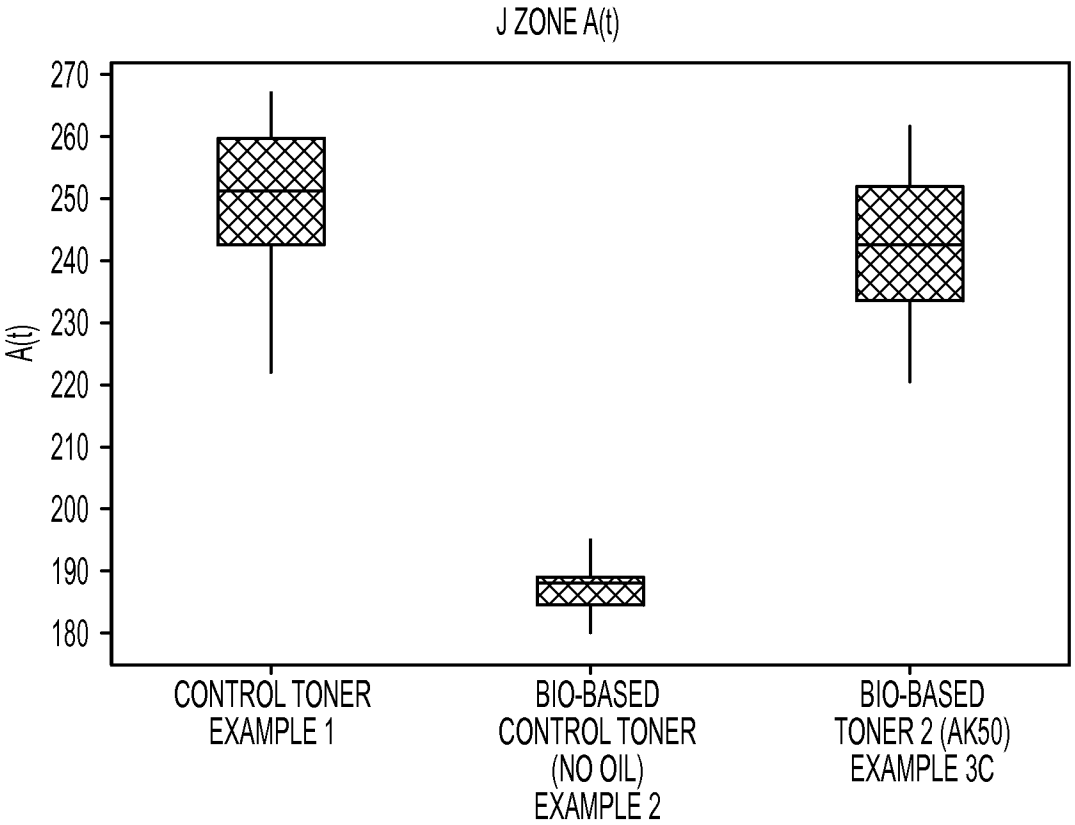
FIG. 9 is a graph illustrating the range in the intrinsic charge parameter A(t) in J zone for a bio-resin based toner as compared to a bio-based control toner without oil and a conventional control toner without oil.
Figure 10:
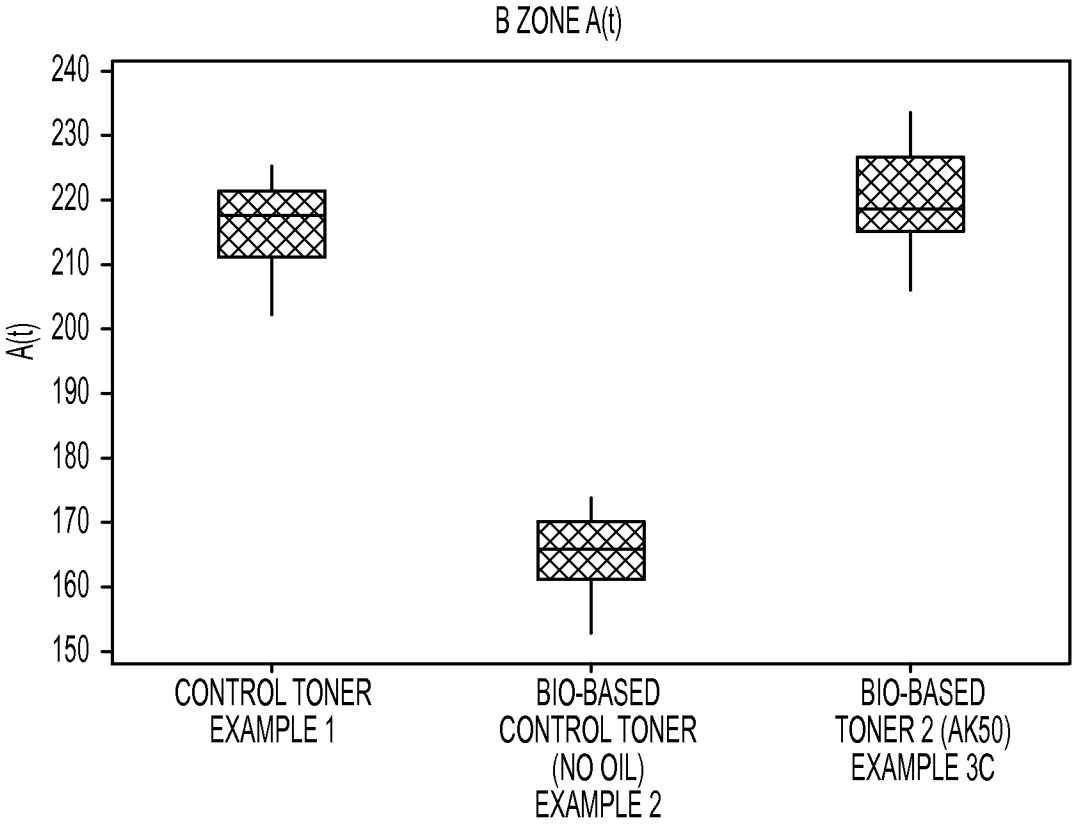
FIG. 10 is a graph illustrating the range in the intrinsic charge parameter A(t) in B zone for a bio-resin based toner as compared to a bio-based control toner without oil and a conventional control toner without oil.
Figure 11:
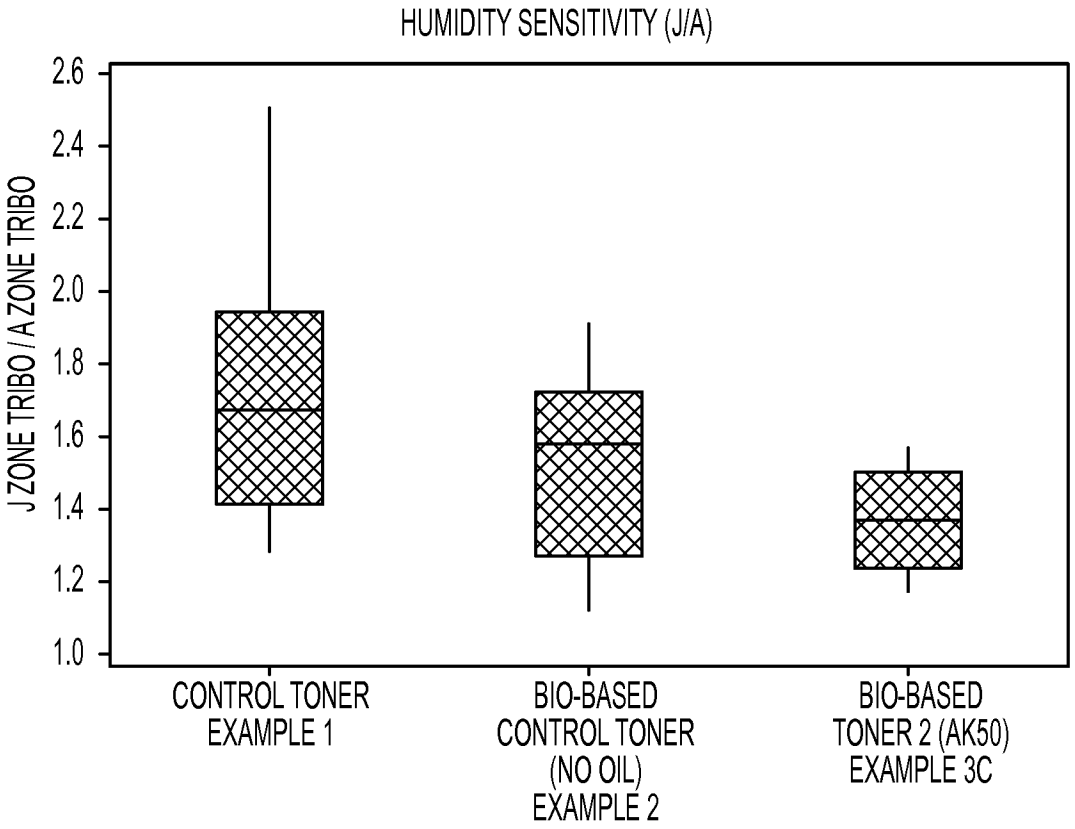
FIG. 11 is a graph illustrating the humidity sensitivity for a bio-resin based toner as compared to a bio-based control toner without oil and a conventional control toner without oil.

Next, the two control toners Example 1 and Example 2, and Bio-based Toner Example 3C were evaluated for charge in A zone (80° F./80% R.H), J zone (70° F./10% R.H) and B zone (70° F./50% R.H) in a Xerox Workcenter 5855 printer. The results are shown in FIGS. 5-7, respectively. As seen, the oil clearly increases A zone charge while keeping B and J zone charge about the same. Toner 3C also has comparable charge to the Non Bio control Toner Example 1 in all three zones. FIGS. 8-10 show the results from stability assessment in A zone, J zone and B zone, respectively. As shown, the Bio-based Toner 3C appeared to have more stable A(t) than both the two control toners Example 1 and Example 2. Lastly, FIG. 11 shows the humidity sensitivity as compared between the non bio Control Toner, Bio-based Control Toner and Bio-based Toner 3C. As seen, the presence of oil reduces the J/A humidity sensitivity.

Testing Performance: Fluorinated Oil

A comparison of the prepared toners is shown in Table 8. The toner formulations were as follows:

TABLE 8

| Name | Parent Particle | Particle Weight | Silica R972L | Titania SMT150 | Oil Name | Oil |
|---|---|---|---|---|---|---|
| Bio-based Toner (with KRYTOX oil) Example 3D | Bio-resin | 75 g | 0.585 g | 0.128 g | KRYTOX | 0.225 mL |
| Control Bio-based Toner (no oil) Example 2 | Bio-resin | 75 g | 0.585 g | 0.128 g | None | 0 mL |
| Control (non bioresin) Toner Example 1 | Non bio-resin | 75 g | 0.585 g | 0.128 g | None | 0 mL |

Figure 12:
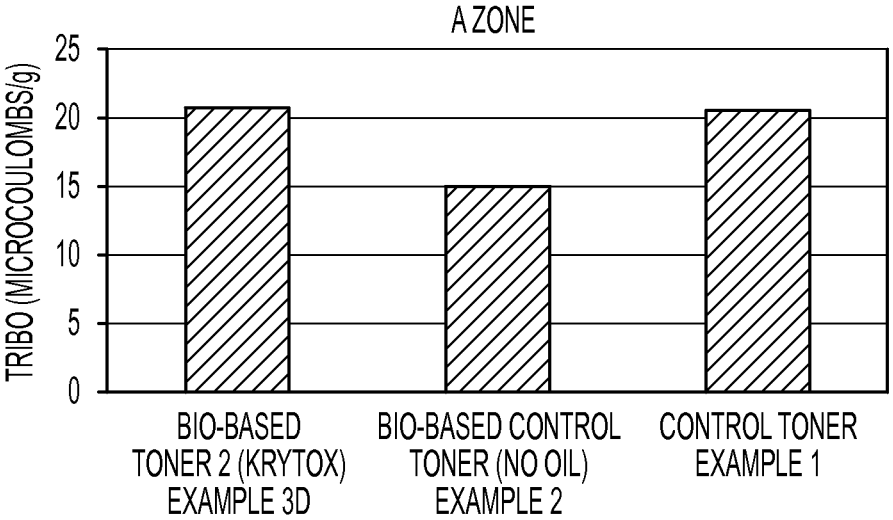
FIG. 12 is bar graph illustrating a comparison of A zone tribo of bio-resin based toner treated with fluorinated oil to no oil controls.
Figure 13:
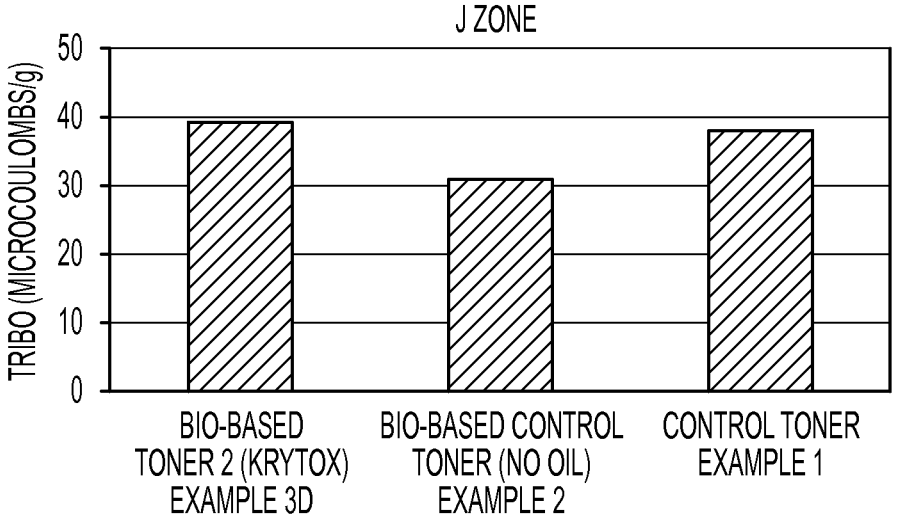
FIG. 13 is bar graph illustrating a comparison of J zone tribo of bio-resin based toner treated with fluorinated oil to no oil controls.

All the toners were evaluated for charge in A zone (80° F./80% R.H) and J zone (70° F./10% R.H). The results are shown in FIGS. 12 and 13, respectively. The bio-resin based toner was blended with KRYTOX oil (available from DuPont (Wilmington, Del.)) Example 3D had about 5.5 tribo units greater charge (A zone charge of 20.5 units; an increase in A zone charge of 36%) than the no oil bio-resin toner control Example 2. The A zone charge of oil treated bio-based toner is equivalent to that of the control (non bio-resin) toner.

Like with the silicone oil, this is a big improvement and brings the A zone charge of the bio-based toner to within conventional (non bio-resin) toner specifications. The J zone charge of the bio-based toner was slightly increased over the no oil bio-based toner, but was still comparable to that of the conventional toner. Thus, the data demonstrates that the oil additives clearly increase the A zone charge without increasing the J zone charge to out of specification limits.

In summary, the present embodiments disclose a novel method to decrease humidity sensitivity and increase A zone charge of toners made with bio-resins. In addition, the use of this oil may facilitate incorporating significantly greater than 20% of a bio-resin into the toner. Currently, the amount of bio-resin incorporated is limited due to the moisture sensitivity of the bio-resin and the depression of A zone charge because of increased moisture absorption by the bio-resin.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

Unless specifically recited in a claim, steps or components of claims should not be implied or imported from the specification or any other claims as to any particular order, number, position, size, shape, angle, color or material.

All references cited herein are herein incorporated by reference in their entireties.

What is claimed is:

1. A bio-based toner comprising:

a resin blend comprising a petroleum based resin and a bio-based resin one or more hydrophobic oil additives;

a colorant; and one or more additives, wherein the toner has bio-content of greater than 25% by weight and does not exhibit moisture sensitivity.

2. The bio-based toner of claim 1, wherein the one or more hydrophobic oil additives are selected from the group consisting of silicone-based oils, fluorinated oils, petroleum based mineral oils, plant or animal based fatty acids and triglycerides, and mixtures thereof.

3. The bio-based toner of claim 2, wherein the silicone-based oils are selected from the group consisting of polysiloxanes, with the chemical formula $[R_2SiO]n$, where R is an organic group such as hydride, methyl, ethyl, phenyl and mixtures thereof.

4. The bio-based toner of claim 2, wherein the fluorinated oils are selected from the group consisting of polyhexafluoropropylene oxide polymers and mixtures thereof.

5. The bio-based toner of claim 1 having an A zone charge of from about 14 to about 22.

6. The bio-based toner of claim 1 having an increase in A zone charge of greater than 30% than for the same bio-based toner without the one or more hydrophobic oil additives.

7. The bio-based toner of claim 1, wherein the bio-resin is present in the toner in an amount of from about 25 to about 95% by weight of the toner.

8. The bio-based toner of claim 1, where the one or more hydrophobic oil additives are present in the toner in an amount of from about 0.1 to about 0.3% by weight of the toner.

9. The bio-based toner of claim 1, wherein a weight ratio of the oil additive to bio-resin is from about 1:950 to about 1:8.

10. The bio-based toner of claim 1, wherein the one or more additives include a silica or titania surface additive.

11. The bio-based toner of claim 10, wherein the silica or titania surface additive is present in an amount of from about 0.1 to about 8% by weight of the toner.

12. The bio-based toner of claim 1, wherein the one or more optional additives are selected from the group consisting of internal charge control agents, pigment dispersants, flow additives, embrittling agents, and mixtures thereof.

13. A developer comprising:

a bio-based toner; and a toner carrier, the bio-based toner comprising a resin blend comprising a petroleum based resin and a bio-based resin one or more hydrophobic oil additives;

a colorant; and one or more additives, wherein the toner has bio-content of greater than 25% by weight and does not exhibit moisture sensitivity.

14. The developer of claim 13, wherein the one or more hydrophobic oil additives are selected from the group consisting of silicone-based oils, fluorinated oils, petroleum based mineral oils, plant or animal based fatty acids and triglycerides, and mixtures thereof.

15. The developer of claim 13, wherein the bio-based toner has an increase in A zone charge of from about 30 to about 50% greater than for the same bio-based toner without the one or more hydrophobic oil additives.

16. The developer of claim 13, wherein the bio-resin is present in the toner in an amount of from about 25 to about 75% by weight of the toner.

17. The developer of claim 13, wherein a weight ratio of the oil additive to bio-resin in the bio-based toner is from about 1:950 to about 1:8.

18. The developer of claim 13, wherein the one or more additives in the bio-based toner include a silica or titania surface additive.

19. A method of making a toner comprising mixing a bio-resin with a colorant to form a toner mixture;

grinding the toner mixture;

classifying the ground toner mixture to form toner particles; and mixing the toner particles with one or more hydrophobic oil additives to form coated toner particles.

20. The method of claim 19, wherein the ground toner mixture is classified to from a toner having a particle size of about 7.5 to about 9.5 microns.

* * * * *